US012146410B1

(12) United States Patent
Liao et al.

(10) Patent No.: US 12,146,410 B1
(45) Date of Patent: Nov. 19, 2024

(54) METHOD FOR DEWATERING COAL MINE GOAF BY CROSSING NEIGHBORING GOAF

(71) Applicants: PING AN COAL MINING ENGINEERING TECHNOLOGY RESEARCH INSTITUTE CO., LTD, Huainan (CN); HUAINAN MINING (GROUP) CO., LTD, Huainan (CN)

(72) Inventors: Qingfa Liao, Huainan (CN); Bing Li, Huainan (CN); Yingui Gao, Huainan (CN); Hongwei Wang, Huainan (CN); Chenglin Chang, Huainan (CN); Shaobo Yin, Huainan (CN); Lin Hu, Huainan (CN); Yanqing Li, Huainan (CN); Hao Li, Huainan (CN)

(73) Assignees: PING AN COAL MINING ENGINEERING TECHNOLOGY RESEARCH INSTITUTE CO., LTD, Huainan (CN); HUAINAN MINING (GROUP) CO., LTD, Huainan (CN)

( * ) Notice: Subject to any disclaimer, the term of this patent is extended or adjusted under 35 U.S.C. 154(b) by 0 days.

(21) Appl. No.: 18/636,300

(22) Filed: Apr. 16, 2024

Related U.S. Application Data

(63) Continuation of application No. PCT/CN2023/118207, filed on Sep. 12, 2023.

(30) Foreign Application Priority Data

Aug. 7, 2023 (CN) ..... 202310993997.4

(51) Int. Cl.

| | |
|---|---|
| ***E21F 16/00*** | (2006.01) |
| ***E21B 7/04*** | (2006.01) |
| ***E21B 33/05*** | (2006.01) |

(52) U.S. Cl.
CPC ..... *E21F 16/00* (2013.01); *E21B 7/04* (2013.01); *E21B 33/05* (2013.01)

(58) Field of Classification Search
None
See application file for complete search history.

(56) References Cited

U.S. PATENT DOCUMENTS 4,986,696 A * 1/1991 Pera ..... E21F 17/00 405/36

FOREIGN PATENT DOCUMENTS

CN 106555609 A 4/2017
CN 108468566 A 8/2018
(Continued)

*Primary Examiner* — Taras P Bemko
(74) *Attorney, Agent, or Firm* — Bayramoglu Law Offices LLC

(57) ABSTRACT

A method for dewatering a coal mine goaf by crossing a neighboring goaf is applicable to a scenario including a first goaf, a second goaf, and a third goaf located sequentially at one side of a roadway. A directional hole mechanism is provided between the roadway and the second goaf as well as between the roadway and the third goaf. The directional hole mechanism passes through a coal seam floor at a bottom of the goaf and is communicated to the second goaf and the third goaf. The directional hole includes a first directional hole and a second directional hole. The first directional hole is communicated to the second goaf, the second directional hole is communicated to the third goaf, and the first directional hole is provided with a casing structure.

10 Claims, 3 Drawing Sheets

(56) References Cited

FOREIGN PATENT DOCUMENTS

| | | | | | |
|---|---|---|---|---|---|
| CN | 110374674 | A | | 10/2019 | |
| CN | 111140279 | A | | 5/2020 | |
| CN | 112049679 | A | | 12/2020 | |
| CN | 114412559 | A | | 4/2022 | |
| CN | 114562331 | A | | 5/2022 | |
| CN | 114687796 | A | * | 7/2022 | |
| CN | 117888948 | A | * | 4/2024 | |
| SU | 1745944 | A1 | | 7/1992 | |
| WO | WO-2018192067 | A1 | * | 10/2018 | ..... E21F 11/00 |

* cited by examiner

METHOD FOR DEWATERING COAL MINE GOAF BY CROSSING NEIGHBORING GOAF

CROSS-REFERENCE TO THE RELATED APPLICATIONS

This application is a continuation application of International Application No. PCT/CN2023/118207, filed on Sep. 12, 2023, which is based upon and claims priority to Chinese Patent Application No. 202310993997.4, filed on Aug. 7, 2023, the entire contents of which are incorporated herein by reference.

TECHNICAL FIELD

The present disclosure relates to the technical field of water prevention and control in coal mine goafs, and in particular to a method for dewatering a coal mine goaf by crossing a neighboring goaf.

BACKGROUND

Mine water disasters have always been one of the important factors that restrict coal safety production in China. According to statistics, 60% of mine accidents are related to the action of groundwater, and among the major coal mine accidents in China, coal mine water disasters account for a high proportion. Various forms of water flowing into mines will cause production losses and casualties, leading to various negative environmental effects, and affect normal extraction of a large amount of coal resources.

The main cause of water inrush accidents is goaf water within or around the mining area. Water detection and drainage is an effective measure to prevent water inrush accidents, and coal mines must do a good job in water detection and drainage.

At present, the main method for preventing and controlling goaf water is to use a conventional rotary drill to conduct advanced detection and drainage of goaf water, in order to eliminate the threat of goaf water to coal mine production. However, the current conventional method can only detect and drain a neighboring goaf at one side of the coal pillar beside the roadway, for example, the first goaf 2 shown in FIG. 1. The first goaf 2 is adjacent to the coal pillar beside the roadway, which is easy for advanced detection and drainage. However, in severe cases, if the remaining goafs are not dewatered in a timely manner, it will pose a safety hazard. Currently, it is not possible to cross the neighboring goaf to detect and dewater other goafs, for example, the second goaf 3 and the third goaf 4 shown in FIG. 1. Moreover, the conventional drilling method suffers from the problems of small drilling length and easy deviation of the drilling trajectory from design parameters, making it hard to accurately drill to the designed target layer.

In view of the above defects, the present disclosure designs a device and method for dewatering a coal mine goaf by crossing a neighboring goaf. The present disclosure combines on-site underground construction experiments and takes into account the shortcomings of traditional methods for goaf water detection and drainage.

SUMMARY

A technical problem to be solved by the present disclosure is that the prior art cannot cross a neighboring goaf to dewater a remaining goaf.

To solve the above technical problem, the present disclosure provides the following technical solution.

The present disclosure provides a dewatering method of a device for dewatering a coal mine goaf by crossing a neighboring goaf, including the following steps:

S1: calculating a critical hydraulic connection value 1 between neighboring goafs according to an equation;

S2: preparing a drilling site as required, and constructing a settling pond;

S3: determining that, if a thickness of a coal pillar is less than the critical hydraulic connection value 1 between the neighboring goafs calculated in step S1, a second goaf and a third goaf are hydraulically communicated with each other, and only drilling a first directional hole; and determining that, if the thickness of the coal pillar is greater than the critical hydraulic connection value 1 between the neighboring goafs calculated in step S1, goaf water in the second goaf is completely blocked from goaf water in the third goaf, and the second goaf is not hydraulically communicated with the third goaf due to the coal pillar, and drilling a second directional hole in addition to the first directional hole, where the first directional hole and the second directional hole are drilled separately;

S4: inserting a water stop casing into the first directional hole drilled, cementing the water stop casing, and carrying out a pressure test until a qualified pressure; and S5: measuring a water output from the hole after drilling is completed; and re-drilling in case of a decrease in the water output.

In a further solution of the present disclosure, in step S1, the critical hydraulic connection value l between the neighboring goafs is calculated as follows:

$$l = \sqrt[3]{\frac{3a^3(1-\mu)p}{40E}}$$

where, a denotes a conversion radius of a working face; u denotes a Poisson's ratio; E denotes a shear strength of coal; P denotes a water pressure; and the critical hydraulic connection value l between the neighboring goafs is calculated as a basis for the drilling construction in step S3.

In a further solution of the present disclosure, the first directional hole and the second directional hole are drilled according to a U-shaped trajectory.

In a further solution of the present disclosure, the first directional hole is drilled as follows:

A1: preparing a drilling rig with a large-diameter drill bit, and adjusting a drilling angle of the drill bit to −10°;

A2: inserting the water stop casing into the hole when the drill bit reaches a depth of 10-20 m, where the casing has a length of 8-10 m, and is provided with a flange, a pressure gauge, and a high-pressure gate valve;

A3: fixing an outer wall of the water stop casing to a hole wall through polyurethane, and sealing with cement; and A4: adjusting, when a drill rod reaches an expected floor position in the second goaf, the drill rod to be inclined, such that the drilling angle gradually turns from a horizontal to a top, thereby forming a final drilling angle of +10°.

In a further solution of the present disclosure, the second directional hole is drilled as follows:

B1: preparing a drilling rig with a large-diameter drill bit, and adjusting a drilling angle of the drill bit to −10°;

B2: inserting a water stop casing into the hole when the drill bit reaches a depth of 10-20 m, where the casing has a length of 8-10 m, and is provided with a flange, a pressure gauge, and a high-pressure gate valve;

B3: fixing an outer wall of the water stop casing to a hole wall through polyurethane, and sealing with cement;

B4: adjusting, when the drill rod reaches an expected floor position in the second goaf, the drill rod to be inclined, such that the drilling angle gradually turns from a horizontal to a top, thereby forming a final drilling angle of +10°; and B5: determining that, when a feed pressure on the drilling rig suddenly drops or becomes 0, the drill rod enters the third goaf; and stopping drilling.

In a further technical solution of the present disclosure, in step S4, the cementing the water stop casing, and carrying out a pressure test includes:

S41: injecting, by a mud pump, water into the hole after 48 h of cementing; holding a water pressure at 2.5 MPa for 30 min;

S42: observing whether there is any leakage in the proximity of a hole wall and a conductor pipe; and S43: determining that, if there is no leakage or if a pressure drop within 30 min does not exceed 0.5 MPa, the cementing is qualified; or determining that, if there is leakage or the pressure drop is greater than 0.5 MPa, grouting cementation is needed until the qualified pressure.

In a further solution of the present disclosure, the method is applicable to a scenario, including a first goaf, the second goaf, and the third goaf located sequentially at one side of a roadway; a directional hole mechanism is provided between the roadway and the second goaf as well as between the roadway and the third goaf; and the directional hole mechanism passes through a coal seam floor at a bottom of the goaf and is communicated to the second goaf and the third goaf; and the directional hole includes the first directional hole and the second directional hole; the first directional hole is communicated to the second goaf; the second directional hole is communicated to the third goaf; and the first directional hole and the second directional hole each are provided therein with a casing structure.

In a further solution of the present disclosure, the first directional hole is communicated with the second directional hole; the second directional hole is communicated to a tail end of the first directional hole; and the second directional hole is also provided therein with a casing structure.

In a further solution of the present disclosure, the second directional hole is located below the first directional hole, and the second directional hole and the first directional hole are arranged in parallel.

In a further solution of the present disclosure, the casing structure includes the water stop casings provided in the first directional hole and the second directional hole; and the water stop casing is provided with a flange, a pressure gauge, and a high-pressure gate valve.

Compared with the prior art, beneficial effects of the present disclosure are as follows:

1. The present disclosure penetrates the coal seam floor through directional drilling, achieving drilling across the neighboring goaf. The present disclosure expands the range of goaf detection and drainage, increases the length of drilling, and enables advanced dewatering in other goafs that traditional drilling methods cannot achieve. The present disclosure can be promoted and used in the field of coal mines to solve the current threat of goaf water to coal mine production.
2. The present disclosure calculates the critical thickness of a connecting coal pillar according to an equation as the design basis of drilling construction. If the thickness of the coal pillar is less than the critical hydraulic connection value l between the neighboring goafs, it is determined that the second goaf and the third goaf are hydraulically communicated with each other, and only the first directional hole is drilled. If the thickness of the coal pillar is greater than the critical hydraulic connection value 1 between the neighboring goafs, it is determined that the second goaf is not hydraulically communicated with the third goaf due to the coal pillar. That is, the coal pillar completely separates the neighboring goafs, and it is necessary to drill a second directional hole in addition to the first directional hole. The first directional hole and the second directional hole are drilled separately. The design improves the accuracy and safety of drilling by crossing the neighboring goaf, and the theoretical equation calculation avoids untargeted drilling design.
3. The present disclosure inserts a water stop casing into the directional hole and cements the water stop casing to ensure its stability. The present disclosure injects water into the hole through a mud pump and holds the water pressure. The present disclosure detects whether there is any leakage at the hole wall and top. If there is leakage or if the pressure drop exceeds 0.5 MPa, it is determined that it is necessary to continue grouting cementation until the qualified pressure. The design ensures the stability and safety of the water stop casing, preventing the water stop casing from leaking to affect subsequent work.
4. In the present disclosure, during the drilling of the second section, the target layer of the drilling is sandstone below the coal seam floor. A normal distance between the drilling trajectory and the coal seam floor is 10-20 m. The sandstone has a soft texture, and the drilling trajectory is not easily deviated therein. In the sandstone, the drilling speed is fast and the efficiency is higher than in other layers, making it less prone to jamming accidents. If the normal distance between the drilling trajectory and the coal seam floor is too small, it is easy to accidentally penetrate the coal seam during the drilling process. If the normal distance between the hole and the coal seam floor is too large, it is easy to move away from the coal seam. When the distance is too small or too large, the drill rod cannot accurately enter the target goaf. Therefore, the distance between the target layer and the coal seam floor is set as 10-20 m.

Figure 1:
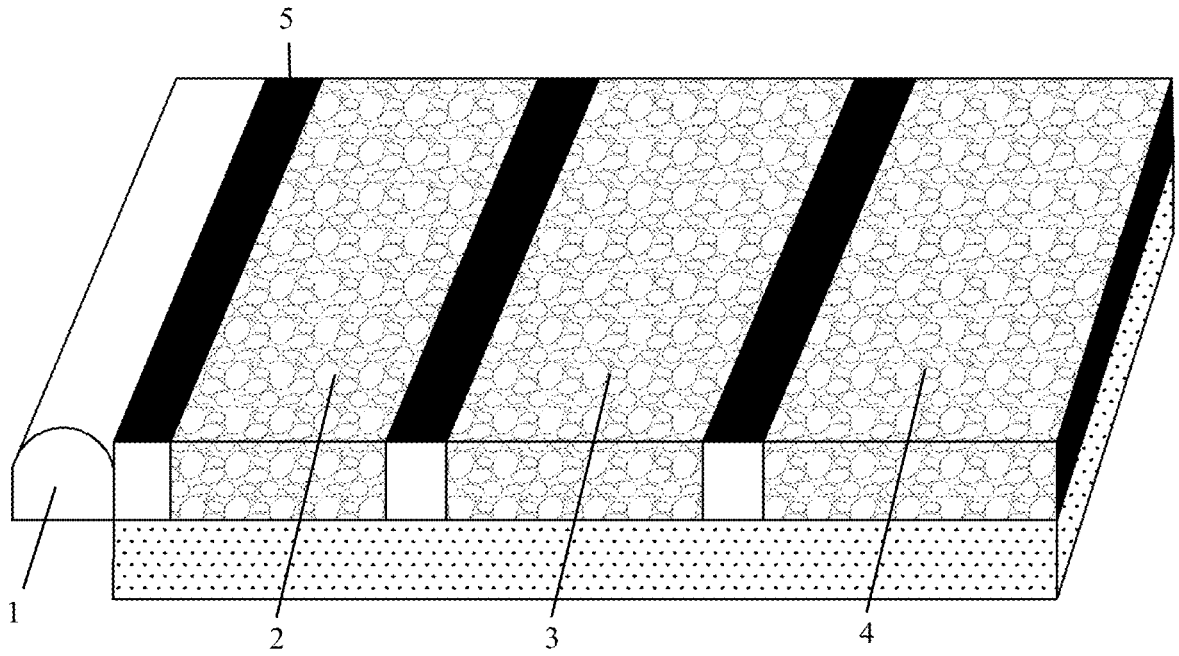
FIG. 1 is a schematic diagram of a scenario before construction according to an embodiment of the present disclosure.

Reference Numerals: 1. roadway; 2. first goaf; 3. second goaf; 4. third goaf; 5. coal pillar; 6. first directional hole; 7. second directional hole; 8. coal seam floor; 9. flange; 10. pressure gauge; 11. high-pressure gate valve; and 12. water stop casing.

DETAILED DESCRIPTION OF THE EMBODIMENTS

In order to make the objectives, technical solutions, and advantages of embodiments of the present disclosure clearer, the following clearly and completely describes the technical solutions in the embodiments of the present disclosure with reference to the embodiments of the present disclosure. Apparently, the described embodiments are some rather than all of the embodiments. All other embodiments obtained by those of ordinary skill in the art based on the embodiments of the present disclosure without creative efforts should fall within the protection scope of the present disclosure.

Embodiment 1

Figure 2:
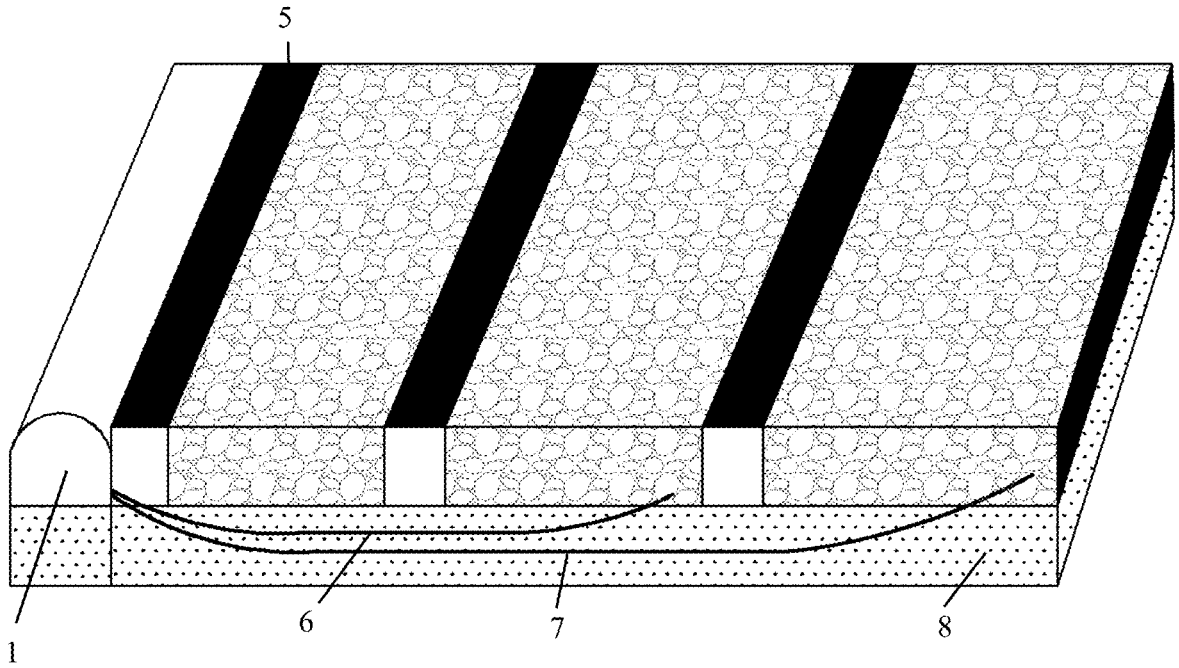
FIG. 2 is a schematic diagram of the scenario when directional drilling is carried out according to an embodiment of the present disclosure.
Figure 3:
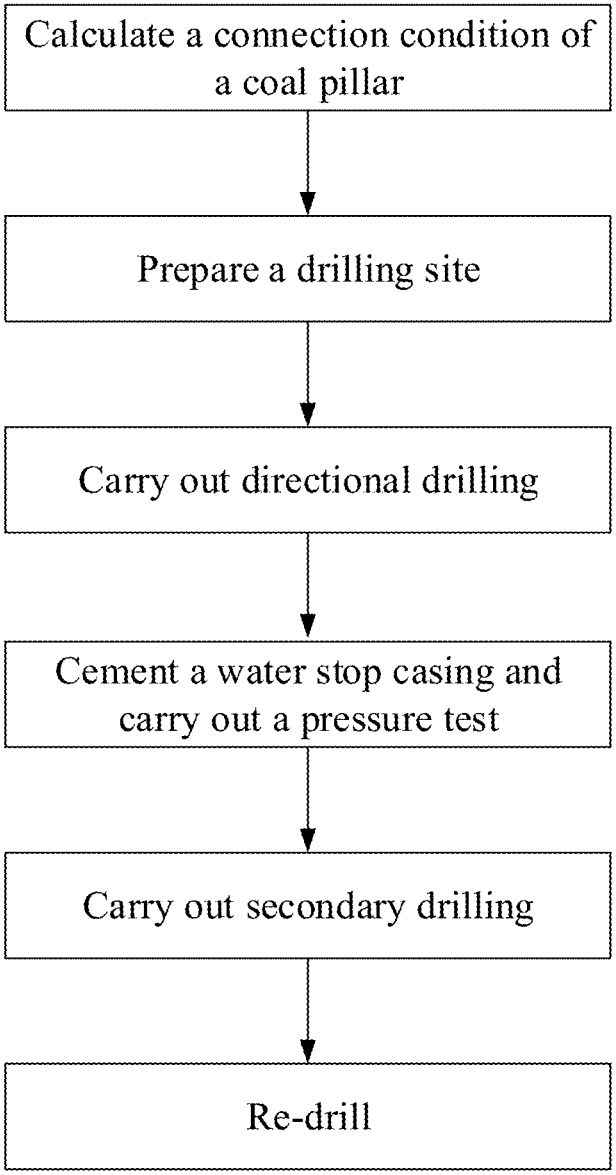
FIG. 3 is a flowchart of operating a device for dewatering a coal mine goaf by a crossing neighboring goaf according to an embodiment of the present disclosure.
Figure 4:
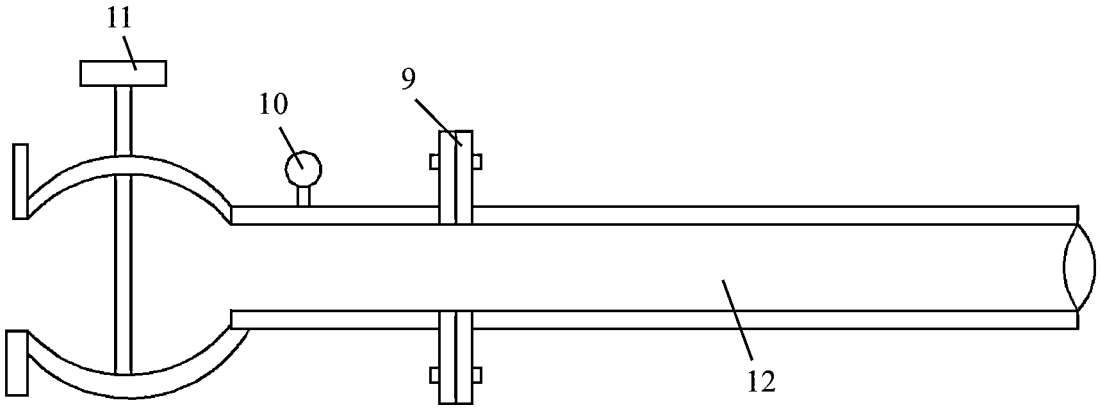
FIG. 4 is a structural diagram of a casing according to an embodiment of the present disclosure.

As shown in FIGS. 1 and 2, a method for dewatering a coal mine goaf by crossing a neighboring goaf is applicable to a scenario, including first goaf 2, second goaf 3, and third goaf 4 located sequentially at one side of roadway 1. First directional hole 6 is provided between the second goaf 3 and the roadway 1 for drainage, and second directional hole 7 is provided between the third goaf 4 and the roadway 1 for drainage. The second directional hole 7 is located below the first directional hole 6, and the second directional hole and the first directional hole are arranged in parallel. The first directional hole 6 is provided with water stop casing 12.

It should be noted that the water stop casing 12 is provided with flange 9, pressure gauge 10, and high-pressure gate valve 11. The pressure gauge 10 is configured to test a water pressure inside the casing, and the high-pressure gate valve 11 is configured to control a flow rate of water inside the casing.

A specific operating principle of a device for dewatering a coal mine goaf by crossing a neighboring goaf is as follows.

Step 1. A critical hydraulic connection value between neighboring goafs is calculated:

$$l = \sqrt[3]{\frac{3a^3(1-\mu)p}{40E}}$$

In the equation, a denotes a conversion radius of a working face; u denotes a Poisson's ratio; E denotes a shear strength of coal; and P denotes a water pressure. The critical hydraulic connection value l between the neighboring goafs is calculated as a basis for the drilling construction in step 3.

In this embodiment, a denotes the conversion radius of the working face. In this embodiment, according to a length of the coal mine working face (2,000 m), a height of the roadway (5 m), and a rock wall area of the roadway, a is 60 m. μ is 0.3. The shear strength E of coal is 0.3 MPa. In this embodiment, a maximum water pressure P measured at a coal mine site is 0.7 MPa. Therefore, l=12.75 m.

Step 2. A drilling site is prepared, and a settling pond is constructed.

The drilling site needs to meet the following conditions. 1. A drilling rig has a vertical space of 12 m or more, making it easy to load and unload a drill rod. 2. The drilling rig has a horizontal space of than 6 m or more, making it easy for a drilling operation. The drilling site has a length of 12 m, a width of 6 m, and a height the same as that of the roadway.

Directional drilling requires a floor of the drilling site to be horizontal. According to a drilling water demand, a water supply capacity is configured as 12 $m^3$/h. Dual power sources, 660/1140 V and 127 V, are provided, with a total power of at least 110 KW. The specification and model of a cable must conform to the total power.

As for the construction of the settling pond, the dimensions of the settling pond is 2 m (length)×2 m (width)×1 m (depth). A drainage system is connected, and a drainage pump is provided, which has a capacity not less than 1.5 times an expected drainage capacity.

Step 3. A first section of directional drilling is constructed.

If a thickness of a coal pillar (an actual thickness of a coal pillar between the second goaf 3 and the third goaf 4) is less than the critical hydraulic connection value l between the neighboring goafs calculated in step 1 (in this embodiment, it is calculated as 12.75 m in step 1), it is determined that the water in the second goaf 3 and the water in the third goaf 4 are communicated with each other, and only a first section of the first directional hole needs to be constructed. If the thickness of the coal pillar is greater than the critical hydraulic connection value l between the neighboring goafs (in this embodiment, it is calculated as 12.75 m in step 1), it is determined that the water in the second goaf is not communicated with the water in the third goaf. That is to say, the water in the two goafs is blocked by the coal pillar, and a first section of the second directional hole needs to be constructed. In other words, the first section of the first directional hole 6 and the first section of the second directional hole 7 are drilled separately. It should be noted that the construction methods for the first directional hole 6 and the second directional hole 7 are the same.

Specifically, the first section of the directional hole is constructed as follows.

A large-diameter drill bit (Φ193 mm) is used, and a drilling angle of the drill rod of the drilling rig is −10°. When the drill bit reaches a depth of 10-20 m, the water stop casing 12 is inserted into the hole. The casing has a length of 8-10 m, and the flange 9, the pressure gauge 10, and the high-pressure gate valve 11 are provided on the casing. An outer wall of the water stop casing 12 is fixed to the hole wall through polyurethane, and the water stop casing is sealed with cement.

Step 4. The water stop casing is provided, and sealed, and tested.

After 48 h of cementing, water is injected into the water stop casing 12 inside the hole through a mud pump. The water pressure inside the water stop casing is held at 2.5 MPa for 30 min. It is observed whether there is any leakage in the proximity of a hole wall and a conductor pipe. If there is no leakage or if a pressure drop within 30 min does not exceed 0.5 MPa, it indicates that the cementation is qualified. If there is leakage or the pressure drop is greater than 0.5 MPa, it is necessary to continue grouting cementation until the qualified pressure.

Step 5. A second section of directional drilling is constructed.

Specifically, the first section of the directional hole is constructed as follows.

A small-diameter drill bit (@98 mm) is used, the drilling angle of the drill rod of the drilling rig is −10°. When the drill rod reaches a corresponding position of a coal seam floor, the drill rod is adjusted to be horizontal, and the drilling angle gradually changes from inclined to horizontal.

When the drill bit reaches a depth of 10-20 m, the drill rod enters an expected floor position in the third goaf 4. The drill rod is adjusted to be inclined, and the drilling angle gradually turns from the horizontal to the top. A final drilling angle is +10°. When a feed pressure on the drilling rig suddenly drops or becomes 0, it indicates that the drill rod enters the third goaf 4. At this point, the drilling is stopped. If the second goaf 3 and the third goaf 4 are rich in water, the amount of water from the hole will increase, and the amount of water drained from the hole will be recorded.

It should be noted that during the drilling of the second section, the target layer of the drilling is the rock layer below the coal seam floor 8, preferably the sandstone of the floor. A normal distance between the drilling trajectory and the coal seam floor is 10-20 m, preferably 10 m. Specifically, the sandstone has a soft texture, and the drilling trajectory is not easily deviated therein. In the sandstone, the drilling speed is fast and the efficiency is higher than in other layers, making it less prone to jamming accidents. If the normal distance between the drilling trajectory and the coal seam floor 8 is too small, it is easy to accidentally penetrate the coal seam during the drilling process. If the normal distance between the hole and the coal seam floor is too large, it is easy to move away from the coal seam. When the distance is too small or too large, the drill rod cannot accurately enter the target goaf. Therefore, the distance between the target layer and the coal seam floor is 10-20 m, preferably 10 m.

The first directional hole 6 and the second directional hole 7 are drilled based on a U-shaped trajectory (as shown in FIG. 2). That is, the directional drilling is carried out according to the U-shaped trajectory. The directional drilling process penetrates the coal seam floor and achieves drilling across the neighboring goaf, increasing the range of goaf detection and drainage and the length of drilling, and enabling advanced dewatering in other goafs that traditional drilling methods cannot achieve.

It should be noted that the hole drilled includes a two-section structure. The hole diameter in the first section is greater than that in the second section, otherwise the drill bit cannot enter the second section due to the decrease in the hole diameter after the casing is placed into the first section. In this embodiment, the drill bit in the first section is a Φ193 mm drill bit and the drilling depth is 10 m. The main purpose of inserting the water stop casing 12 is to seal the formation and install related equipment at the top of the hole. The second section is an open directional hole section. In the second section, the drill bit is a Φ98 mm drill bit, and the drilling trajectory is monitored and adjusted by a drilling measurement instrument so as to drill as designed. The combined trajectory of drilling in the first section and the second section is the U-shaped trajectory, as shown in FIG. 2.

Step 6. Re-drilling is carried out.

After the drilling construction is completed, the drainage hole in the goaf is easily blocked by mud and gravel in the goaf, causing a gradual decrease in the water output of the hole after drilling. If a decrease in the water output is found when the drill rod is pulled out, it is necessary to re-drill. After the drill rod is pulled out, the water output from the hole is first measured. Then, the high-pressure gate valve 11 is closed, and the water pressure is observed. If a decrease in the water output is found during the drainage process, it is necessary to continue re-drilling.

Embodiment 2

The only difference between this embodiment and Embodiment 1 is as follows. The first directional hole 6 is communicated with the second directional hole 7, and the second directional hole 7 is communicated to a tail end of the first directional hole 6. The second directional hole 7 is a branch of the first directional hole 6, and the second directional hole 7 is provided therein with water stop casing 12.

In addition to the first directional hole 6, the second directional hole 7 is drilled through the drill rod until the drill rod enters the expected floor position in the third goaf 4. Then, the drill rod is adjusted to be inclined, and the drilling angle gradually turns from the horizontal to the top. The final drilling angle is +10°. When the feed pressure on the drilling rig suddenly drops or becomes 0, it is determined that the drill rod enters the third goaf 4. At this point, the drilling is stopped.

The foregoing embodiments are only used to explain the technical solutions of the present disclosure, and are not intended to limit the same. Although the present disclosure is described in detail with reference to the foregoing embodiments, those of ordinary skill in the art should understand that they can still modify the technical solutions described in the foregoing embodiments, or perform equivalent substitutions on some technical features therein. These modifications or substitutions do not make the essence of the corresponding technical solutions deviate from the spirit and scope of the technical solutions of the embodiments of the present disclosure.

What is claimed is:

1. A dewatering method of a device for dewatering a coal mine goaf by crossing a neighboring goaf, comprising the following steps:

S1: calculating a critical hydraulic connection value l between neighboring goafs according to an equation;

S2: preparing a drilling site;

S3: determining that, if a thickness of a coal pillar is less than the critical hydraulic connection value 1 between the neighboring goafs calculated in step S1, a second goaf and a third goaf are hydraulically communicated with each other, and only drilling a first directional hole; and determining that, if the thickness of the coal pillar is greater than the critical hydraulic connection value 1 between the neighboring goafs calculated in step S1, goaf water in the second goaf is completely blocked from goaf water in the third goaf, and the second goaf is not hydraulically communicated with the third goaf due to the coal pillar, and drilling a second directional hole in addition to the first directional hole, wherein the first directional hole and the second directional hole are drilled separately;

S4: inserting a water stop casing into the first directional hole drilled, cementing the water stop casing, and carrying out a pressure test on the cement of the water stop casing until a qualified pressure drop is measured over a predetermined time period or there is no leakage over the predetermined time period; and S5: measuring a water output from the hole after drilling is completed; and re-drilling in case of a decrease in the water output.

2. The method for dewatering the coal mine goaf by crossing the neighboring goaf according to claim 1, wherein in step S1, the critical hydraulic connection value 1 between the neighboring goafs is calculated as follows:

$$l = \sqrt[3]{\frac{3a^3(1-\mu)p}{40E}}$$

wherein, a denotes a conversion radius of a working face; u denotes a Poisson's ratio; E denotes a shear strength of coal; P denotes a water pressure; and the critical hydraulic connection value l between the neighboring goafs is calculated as a basis for the drilling construction in step S3.

3. The method for dewatering the coal mine goaf by crossing the neighboring goaf according to claim 1, wherein the first directional hole and the second directional hole are drilled according to a U-shaped trajectory.

4. The method for dewatering the coal mine goaf by crossing the neighboring goaf according to claim 1, wherein the first directional hole is drilled as follows:

A1: preparing a drilling rig with a large-diameter drill bit, and adjusting a drilling angle of the drill bit to −10°;

A2: inserting the water stop casing into the hole when the drill bit reaches a depth of 10-20 m, wherein the casing has a length of 8-10 m, and is provided with a flange, a pressure gauge, and a high-pressure gate valve;

A3: fixing an outer wall of the water stop casing to a hole wall through polyurethane, and sealing with cement;

A4: adjusting, when a drill rod reaches an expected floor position in the second goaf, the drill rod to be inclined, such that the drilling angle gradually turns from a horizontal to a top, thereby forming a final drilling angle of +10°; and A5: determining that, when a feed pressure on the drilling rig suddenly drops or becomes 0, the drill rod enters the second goaf; and stopping drilling.

5. The method for dewatering the coal mine goaf by crossing the neighboring goaf according to claim 1, wherein the second directional hole is drilled as follows:

B1: preparing a drilling rig with a large-diameter drill bit, and adjusting a drilling angle of the drill bit to −10°;

B2: inserting a water stop casing into the hole when the drill bit reaches a depth of 10-20 m, wherein the casing has a length of 8-10 m, and is provided with a flange, a pressure gauge, and a high-pressure gate valve;

B3: fixing an outer wall of the water stop casing to a hole wall through polyurethane, and sealing with cement;

B4: adjusting, when a drill rod reaches an expected floor position in the second goaf, the drill rod to be inclined, such that the drilling angle gradually turns from a horizontal to a top, thereby forming a final drilling angle of +10°; and B5: determining that, when a feed pressure on the drilling rig suddenly drops or becomes 0, the drill rod enters the third goaf; and stopping drilling.

6. The method for dewatering the coal mine goaf by crossing the neighboring goaf according to claim 1, wherein in step S4, the operation of cementing the water stop casing, and carrying out a pressure test comprises:

S41: injecting, by a mud pump, water into the hole after 48 h of cementing; holding a water pressure at 2.5 MPa for 30 min;

S42: observing whether there is any leakage in the proximity of a hole wall and a conductor pipe; and S43: determining that, if there is no leakage or if a pressure drop within 30 min does not exceed 0.5 MPa, the cementing is qualified; or determining that, if there is leakage or the pressure drop is greater than 0.5 MPa, grouting cementation is needed until the qualified pressure.

7. The method for dewatering the coal mine goaf by crossing the neighboring goaf according to claim 1, wherein the method is applicable to a scenario, comprising a first goaf, the second goaf, and the third goaf located sequentially at one side of a roadway; a directional hole mechanism is provided between the roadway and the second goaf as well as between the roadway and the third goaf; and the directional hole mechanism passes through a coal seam floor at a bottom of the goaf and is communicated to the second goaf and the third goaf; and a directional hole comprises the first directional hole and the second directional hole; the first directional hole is communicated to the second goaf; the second directional hole is communicated to the third goaf; and the first directional hole and the second directional hole each are provided therein with a casing structure.

8. The method for dewatering the coal mine goaf by crossing the neighboring goaf according to claim 7, wherein the first directional hole is communicated with the second directional hole; the second directional hole is communicated to a tail end of the first directional hole; and the second directional hole is also provided therein with the casing structure.

9. The method for dewatering the coal mine goaf by crossing the neighboring goaf according to claim 7, wherein the second directional hole is located below the first directional hole, and the second directional hole and the first directional hole are arranged in parallel.

10. The method for dewatering the coal mine goaf by crossing the neighboring goaf according to claim 7, wherein the casing structure comprises the water stop casings provided in the first directional hole and the second directional hole; and the water stop casing is provided with a flange, a pressure gauge, and a high-pressure gate valve.

* * * * *